US005467680A

United States Patent [19]

Kurosaki

[11] Patent Number: 5,467,680

[45] Date of Patent: Nov. 21, 1995

[54] SNARE DRUM STAND

[75] Inventor: Makoto Kurosaki, Shizuoka, Japan

[73] Assignee: Yamaha Corporation, Japan

[21] Appl. No.: 191,558

[22] Filed: Apr. 12, 1993

[30] Foreign Application Priority Data

Apr. 10, 1992 [JP] Japan ..... 4-091236

[51] Int. Cl.[6] ..... G10D 13/02

[52] U.S. Cl. ..... 84/421

[58] Field of Search ..... 84/421

[56] References Cited

U.S. PATENT DOCUMENTS 1,750,803 3/1930 Hayden ..... 84/421

3,405,587 10/1968 Meazzi et al. ..... 84/421

*Primary Examiner*—Steven L. Stephan
*Assistant Examiner*—Cassandra C. Spyrou
*Attorney, Agent, or Firm*—Ostrolenk, Faber, Gerb & Soffen

[57] ABSTRACT

In construction of a snare drum stand having a lower support and an upper center post, four sets of arms are mounted overhead the center post with 90 degrees center angle intervals whilst extending radially outwords. Distant positioning of the radial arms form lugs on the annular brim of a drum allows easy mounting of the drum onto the stand and easy tension adjustment via the lugs.

3 Claims, 4 Drawing Sheets

SNARE DRUM STAND

BACKGROUND OF THE INVENTION

The present invention relates to a snare drum stand, and more particularly relates to improvements in operability of a snare drum stand used for holding a drum overhead.

A snare drum stand is generally made up of an upright center post, radial arms mounted atop the center post via a ball clamper and 3 legs connected to the lower end of the center post in a tripod arrangement.

Conventionally, three radial arms used for holding the drum overhead are arranged atop the ball clamper with 120 degrees center angle intervals.

The drum is provided along its annular brim with 8 or 10 sets of lugs for adjustment of tension on a drum head. When the radial arms are arranged with 120 degrees center angle intervals, at least one of the arms are inevitably positioned quite close to one of the lugs on the annular brim of the drum.

Such close positioning of the radial arm to the lug disenables easy mounting of the drum onto the radial arms. In addition, even after the drum is mounted onto the radial arms, presence of the radial arm near the lug seriously hampers smooth operation of the lug for tension adjustment. In other words, the conventional arrangement of the radial arms with respect to the center post seriously lower operability of the snare drum for which the snare drum stand is used.

SUMMARY OF THE INVENTION

It is thus the basic object of the present invention to improve operability of a snare drum stand.

In accordance with the present invention, four sets of radial arms are arranged with respect to a center post with 90 degrees center angle intervals.

DESCRIPTION OF PREFERRED EMBODIMENTS

Figure 1:
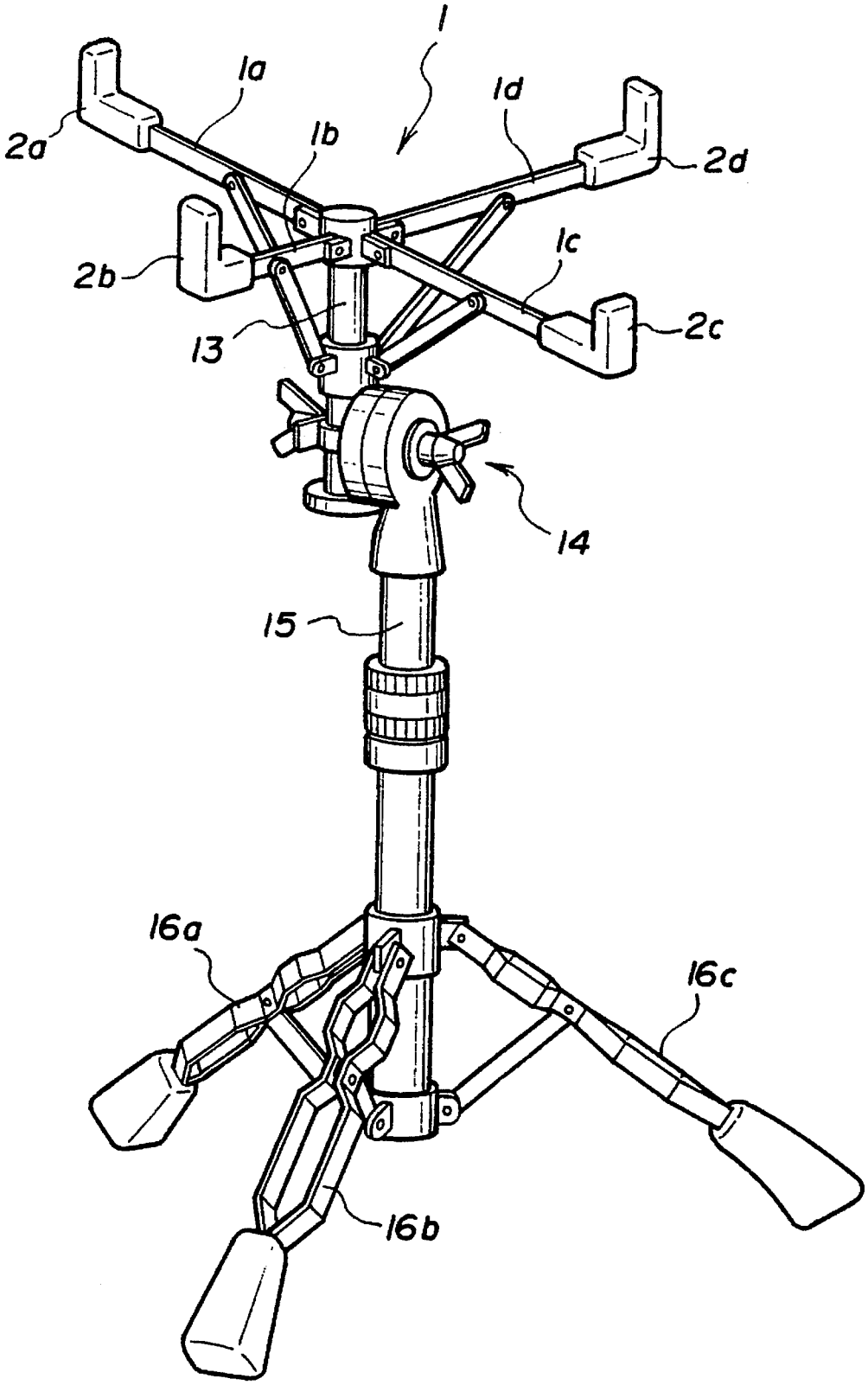
FIG. 1 is a perspective plan view of one embodiment of the snare drum stand in accordance with the present invention.

In FIG. 1, a snare drum stand 1 in accordance with the present invention includes an upright post 15 which is supported on the floor by three tripod type legs 16*a* to 16*c*. A ball clamper 14 of a known construction is mounted atop the center post 15 in order to firmly hold an arm holder shaft 13. By proper manual operation on the ball clamper 14, the angular position of the arm holder shaft 13 with respect to the center post 15 can be adjusted as required.

Four radial arms 1*a* to 1*d* are fixedly connected to the arm holder shaft 13 at their proximal ends. The radial arms 1*a* to 1*d* are provided, at their distal ends, with arm covers 2*a* to 2*d*, respectively, for effective absorption of head vibrations during performance.

Figure 2:
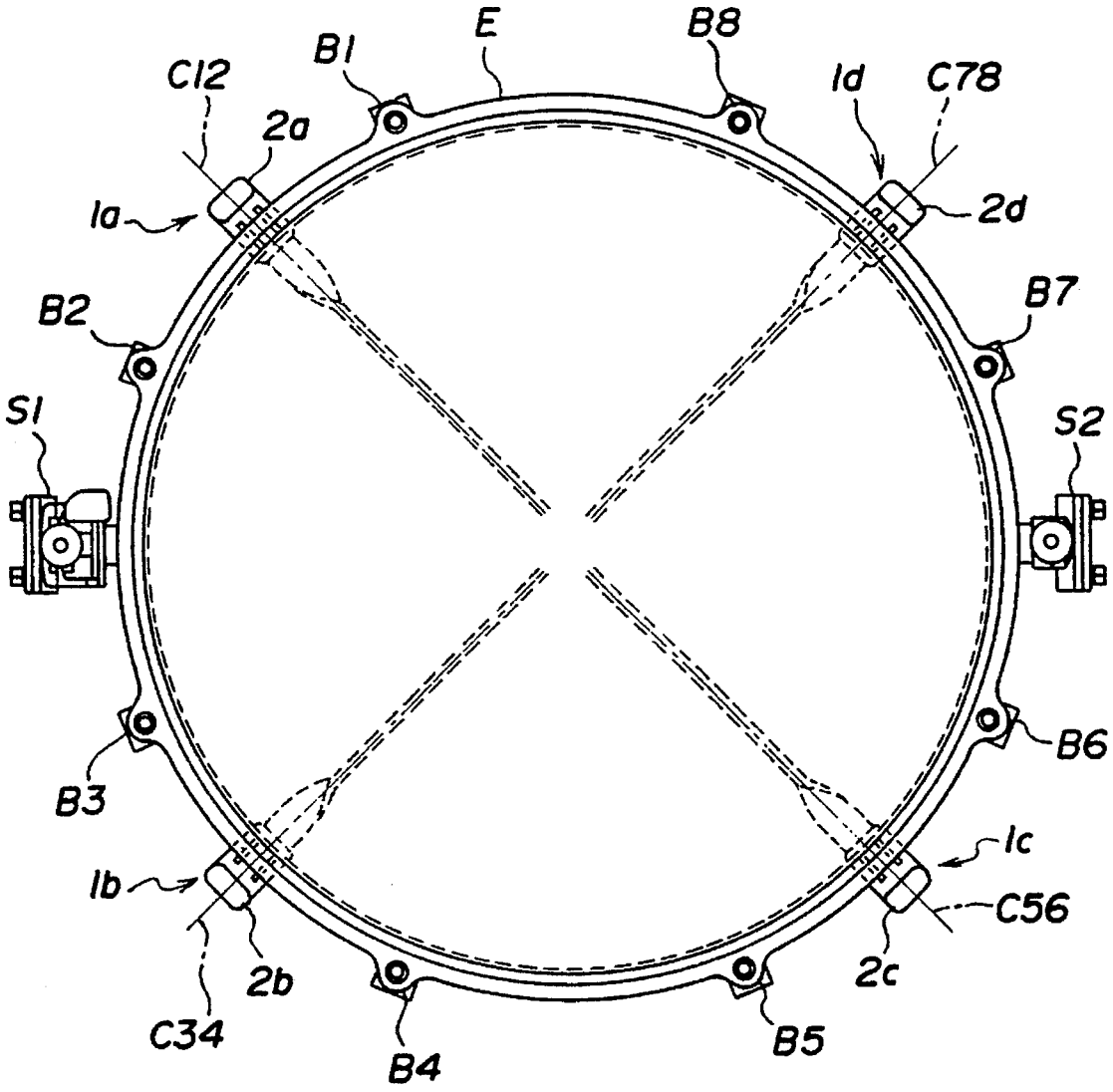
FIG. 2 is a top plan view of the snare drum stand shown in FIG. 1 used in combination with an 8 lug type drum.

FIG. 2 shows relationship in position between the radial arms and lugs of a drum when the snare drum stand in accordance with the present invention is used in combination with an 8 lug type drum. It is clearly seen in the illustration that the distal ends of the radial arms 1*a* to 1*d* are positioned at about the angular centers C12, C34, C56 and C78 between adjacent lugs B1 to B8 on the annular brim E of the drum. Stated otherwise, the distal ends of the radial arms 1*a* to 2*d* are positioned sufficiently distant from the adjacent lugs B1 to B8, respectively. As a consequence, presence of the radial arms along the annular brim E allows easy and correct mounting of a drum on the radial arms 1*a* to 1*d*. In addition, such arrangement of the radial arms 1*a* to 1*d* with respect to the elements S, enables easy manual operation on the lugs for tension adjustment.

Figure 3:
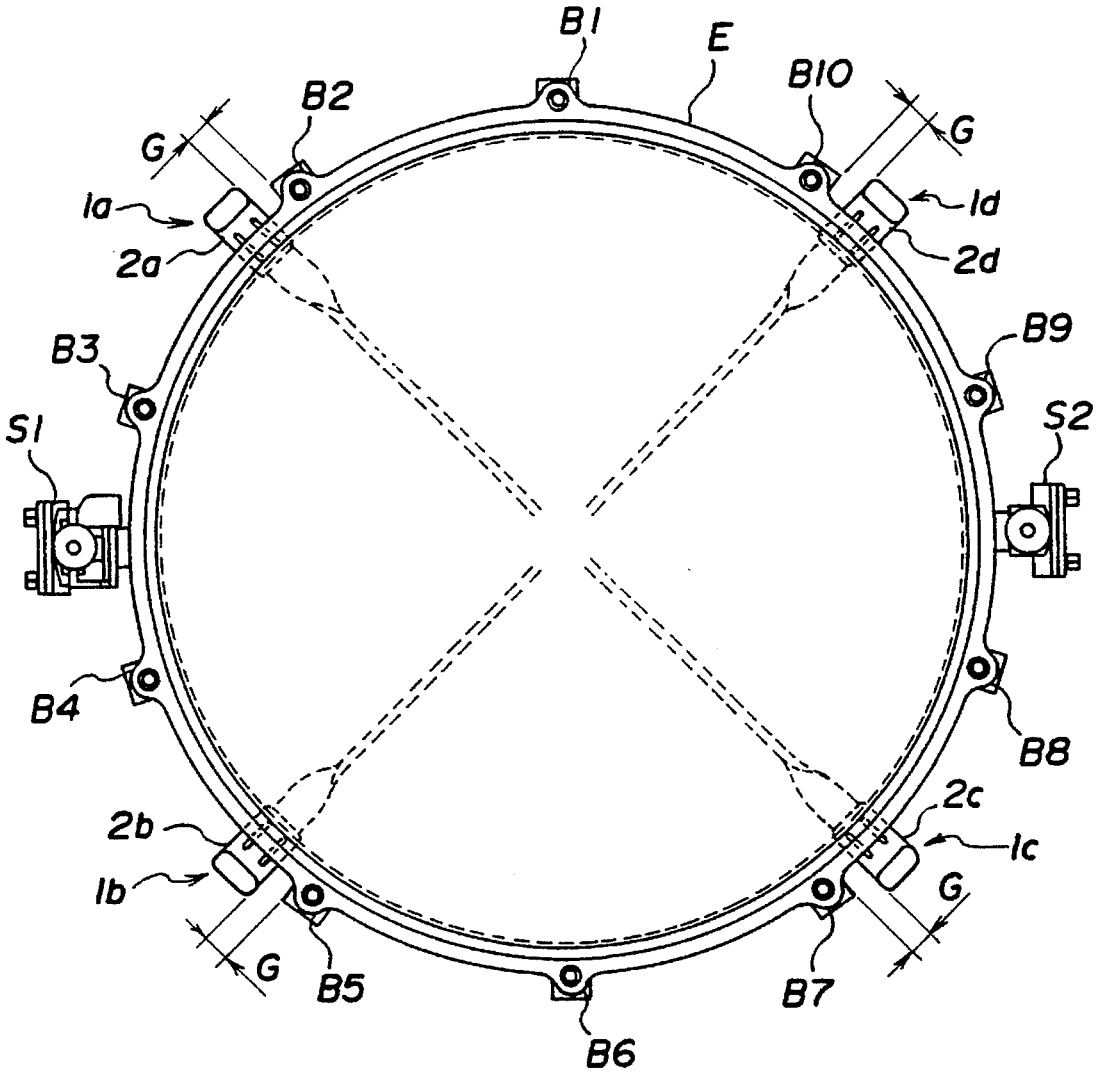
FIG. 3 is a top plan view of the snare drum stand shown in FIG. 1 used in combination with a 10 lug type drum.

FIG. 3 depicts an arm vis lug arrangement when the snare drum stand of the present invention is used for a 10 lug type drum. It will be seen that appreciable gaps G are left between the distal ends of the radial arms 1*a* to 1*d* and adjacent lugs B1 to B8. Like the mode of application shown in FIG. 2, presence of such gaps G between the adjacent radial arms and lugs assure easy mounting of the drum and easy manual operation on the lugs for tension adjustment.

Figure 4:
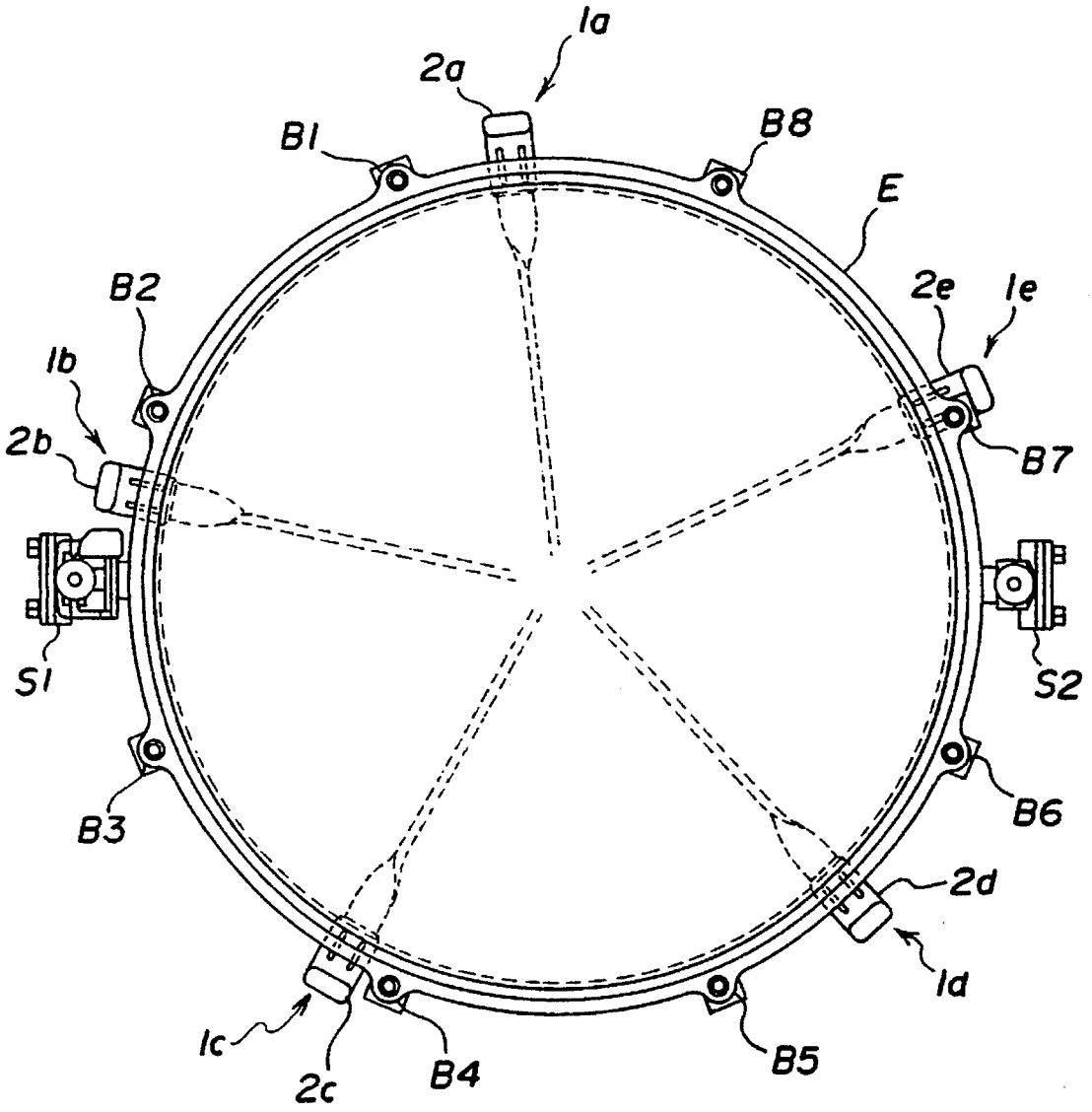
FIG. 4 is a top plan view of a snare drum stand having five radial arms and used in combination with a 8 lug type drum.

In an attempt to further confirm the advantages of the present invention, a snare drum stand with five radial arms, which are arranged with equal center angle intervals, was prepared and used in combination with an 8 lug type drum. A resultant arm vis lug arrangement is shown in FIG. 4. It will be clearly seen in the illustration that the radial arm 1*c* is positioned quite close to the lug B4 and the position of the radial arm 1*e* overlaps that of the lug B7. It is well understood from the result of this experimental trial, that employment of the 90 degrees center angle in accordance with the present invention much improves operability of a snare drum stand. In addition, this specified arm arrangement provides a good reference in position for mounting of the drum onto the snare drum stand.

I claim:

1. A snare drum stand comprising:

an upright center post;

a support connected to a lower end of said center post;

four radial arms extending radially outwards from a common point and in a common plane for supporting a snare drum with 90 degree intervals between adjacent arms; and arm holder means connected to said center post for mounting said arms over said center post.

2. A snare drum stand in accordance with claim 1, wherein the support includes a tripod.

3. A snare drum stand in accordance with claim 2, wherein said arm holder means is adjustably connected to said center post to adjust the angle of said common plane relative to said center post.

* * * * *